US006047999A

United States Patent [19]

Dixon, Jr.

[11] Patent Number: 6,047,999

[45] Date of Patent: Apr. 11, 2000

[54] MAUSOLEUM CRYPT LOCK

[76] Inventor: Herbert Francis Dixon, Jr., 255 Oak Grove Rd. NW., Salem, Oreg. 97304

[21] Appl. No.: 09/173,511

[22] Filed: Oct. 15, 1998

[51] Int. Cl.[7] ..... E05C 7/00

[52] U.S. Cl. ..... 292/42; 292/43; 292/32

[58] Field of Search ..... 27/DIG. 1; 292/32, 292/33, 41–43, 327, 331; 70/1.5, 422

[56] References Cited

U.S. PATENT DOCUMENTS

| | | | |
|---|---|---|---|
| 370,331 | 9/1887 | Hamilton . | |
| 892,458 | 7/1908 | Sparks . | |
| 977,491 | 12/1910 | Vigdal | 220/318 |
| 997,790 | 7/1911 | Fish | 70/1.5 |
| 1,122,550 | 1/1914 | Stevens . | |
| 1,125,626 | 1/1915 | Young et al. . | |
| 1,230,115 | 6/1917 | Clark . | |
| 1,453,375 | 5/1923 | Allen . | |
| 1,884,201 | 10/1932 | Phillippe . | |
| 1,906,318 | 5/1933 | Jensen . | |
| 2,019,413 | 1/1935 | Holz . | |
| 2,216,335 | 10/1940 | Ashton | 292/40 |
| 2,535,275 | 12/1950 | Dixon | 49/465 |
| 2,936,189 | 5/1960 | Pearson | 292/42 |
| 5,297,404 | 3/1994 | Embry | 70/1.5 |
| 5,975,592 | 11/1999 | Lin | 292/37 |

*Primary Examiner*—B. Dayoan
*Assistant Examiner*—Gary Estremsky
*Attorney, Agent, or Firm*—Karen S. Hock

[57] ABSTRACT

A covering and locking device for the open end of a mausoleum crypt having a rigid plate sized to fit into the open end. The plate has a centrally hole through it sized to receive a small pin or other tool for actuating the lock. A plurality of radially sliding locking rods, each rod spaced equally apart from the other, are positioned on the rear face of the plate. A housing for each rod is positioned over the end of its respective rod and is attached to the rear face adjacent outer edges of the plate. A spring encircles each rod and is positioned within the housing, and one end of each spring is attached to its respective rod, while the other end of each spring is attached to its respective housing. A rod restraining clip is removably positioned over the outer ends of the rods and the centrally located hole so that rods remain in the unlocked position until the lock is ready to be used. Preferably, a safety screw is positioned through the hole in the plate and into a hole axially aligned with the hole in the plate in the rod restraining clip to prevent the removal of the rod restraining clip prior to installation.

7 Claims, 3 Drawing Sheets

MAUSOLEUM CRYPT LOCK

BACKGROUND

1. Field of Invention

This invention relates in general to permanent locking devices for compartments, and more particularly to a permanent locking device suitable for closing and locking the open end of a mausoleum crypt.

2. Description of Prior Art

Storage of caskets in mausoleum crypts has become a necessity in recent years. Two reasons for the necessity of mausoleums are 1) a shortage of available space for below ground burials in most cemeteries, and 2) the prohibition of cremation by some religions, as well as the choice not to be cremated by some individuals and family members.

Mausoleums are building structures, typically built of cement, that are comprised of individual interior crypts. The crypts are compartments for the storage of caskets within the mausoleum that have one open end, and usually they are integrally formed with the walls and floor of the mausoleum. The use of mausoleums solves the land shortage problem without resorting to cremation. There is, however, a serious problem with the use of mausoleum crypts that is becoming more widespread. This problem is the destruction of crypts and the theft of the crypt contents. It is a problem due to the typical method of closing and sealing the open ends of the crypts in the mausoleums.

A common way of closing and sealing the open end is simply with a plastic plate, and a sealing compound. Another common way is with a plate cemented into place, or more simply, just cementing in the opening with no plate. After the plate is in place or the opening is cemented over, usually a decorative faceplate or shutter slab, often of marble, is hung over the closed end or ends using various fasteners. This type of arrangement, however, allows the crypt to be broken into with commonly available tools, as no locking mechanism is used on the crypt itself. As such, there is a need for a cost efficient and simple to install device that closes and permanently locks the open ends of the crypts.

A number of permanent locking mechanisms for covering and locking the open ends of burial vaults have been suggested. These locking mechanisms, however, have the following problems:

1. The locking members remain connected to the actuating means after the device is in the locked position. This arrangement has the following consequences:
   a) the requirement that the actuating mechanism needs to be disabled after locking which can result in a complicated design and therefore higher cost;
   b) the potential for the supposedly disabled actuating means to be enabled through tampering and/or force resulting in unlocking; and
   c) the potential uncertainty to the installer as to whether the actuating means has been disabled or not.
2. The actuating means or the handle/stem etc. often remain externally accessible. Even if the actuating means have been disabled, this arrangement can create the expectation in the potential vandal that the lock is potentially unlockable. Another problem with an external handle/stem etc. specific to mausoleum crypts is the inability to hang a face plate flush against the sealed crypts.

For example, U.S. Pat. No. 1,125,626 discloses a permanent locking mechanism that utilizes a ratchet and pawl system to disable the actuating means which remains accessible. With this arrangement there is the potential for the pawl to break with the application of enough force to the pawl through the accessible actuating means.

U.S. Pat No. 1,122,550 discloses a vault lock door that permanently locks the locking members through the disablement of the stem connected to the actuating means with a wedge surrounding the stem. Here the stem is accessible for tampering, and the locking members are still connected to the actuating means.

U.S. Pat. No. 1,906,318 discloses a grave vault with a locking end that permanently locks the locking members through the use of a spring activated latch on one of the locking members that prevents the movement of the locking members. Again, the stem connected to the actuating mechanism is left accessible, and the locking members are still connected to the actuating means.

U.S. Pat. No. 892,458 discloses a burial vault lock that is permanently locked by the combination of 1. a pawl engaging a ratchet disk, thus disabling the actuating mechanism of the ratchet disk, and 2. cement poured into the locking mechanism. Again, the pawl could be disabled through the use of force on the accessible actuating means.

The current invention circumvents the issue of tampering and break ins because the actuating means do not remain connected to the locking members after the locking members are in the locked position. In addition, after locking, the actuating means are not externally accessible.

OBJECTS AND ADVANTAGES

Accordingly, several objects of the present invention are:

a) to prevent break ins and theft of crypt contents;

b) to provide for a locking device that is permanent through the disconnection of the locking members from the actuating means after the device is in place thus making it impossible to retract the locking members;

c) to provide a locking device that prevents tampering or attempts at break-ins due to the lack of visible external parts;

d) to provide for economical manufacture with a minimum of parts;

e) to provide for simple installation of the crypt lock;

f) to provide for a clean installation that leaves no mess in the mausoleum.

These and further objects will be apparent from the following description and drawings of the preferred embodiments thereof.

BRIEF SUMMARY OF THE INVENTION

The present invention is directed to a device that satisfies the need for a secure and tamper proof mausoleum crypt while being cost efficient, as well as simple, quick, and clean to install. The crypt lock comprises a rigid plate adapted to fit into an open end of a crypt. The plate has a centrally located hole sized to receive a pin or other suitable tool such as a screwdriver. A plurality of radially sliding locking rods, each rod spaced equally apart from the other, are positioned on the rear face of the plate. Each rod has an inner end that has a circumferential groove and an outer end. The inner end of each rod is positioned adjacent the central hole, and the outer end of each rod is positioned adjacent the outer edges of the plate. A housing for each rod is attached to the rear face of the plate and positioned over and adjacent each outer end of each rod. A spring encircles each rod adjacent the outer end of each rod and within the housing. One end of each spring is attached to its respective rod, and the other end is attached to the housing of its respective rod. A rod restraining clip is removably positioned on the rear face of the plate over the grooves in the inner ends of the rods and the centrally located hole, whereby the springs on the rods are kept compressed and the rods are prevented from moving. For added safety, a screw may be temporarily positioned through the hole in the plate and a hole in the rod restraining clip, the hole in the rod restraining clip axially aligned with the hole in the plate so that the rod retaining clip remains in position until the lock is ready for use.

BRIEF DESCRIPTION OF THE DRAWINGS

These and other features, aspects, and advantages of the present invention will become better understood with regard to the following description, appended claims, and accompanying drawings where:

DETAILED DESCRIPTION

Two embodiments of the mausoleum crypt lock are illustrated and described herein. The preferred embodiment is shown in FIGS. 1–5 inclusive and is suited to adapt to existing mausoleum crypt openings. A second embodiment is shown in FIG. 6 and is suited for use with mausoleum crypts built with openings pre-formed to receive the crypt lock.

Figure 1:
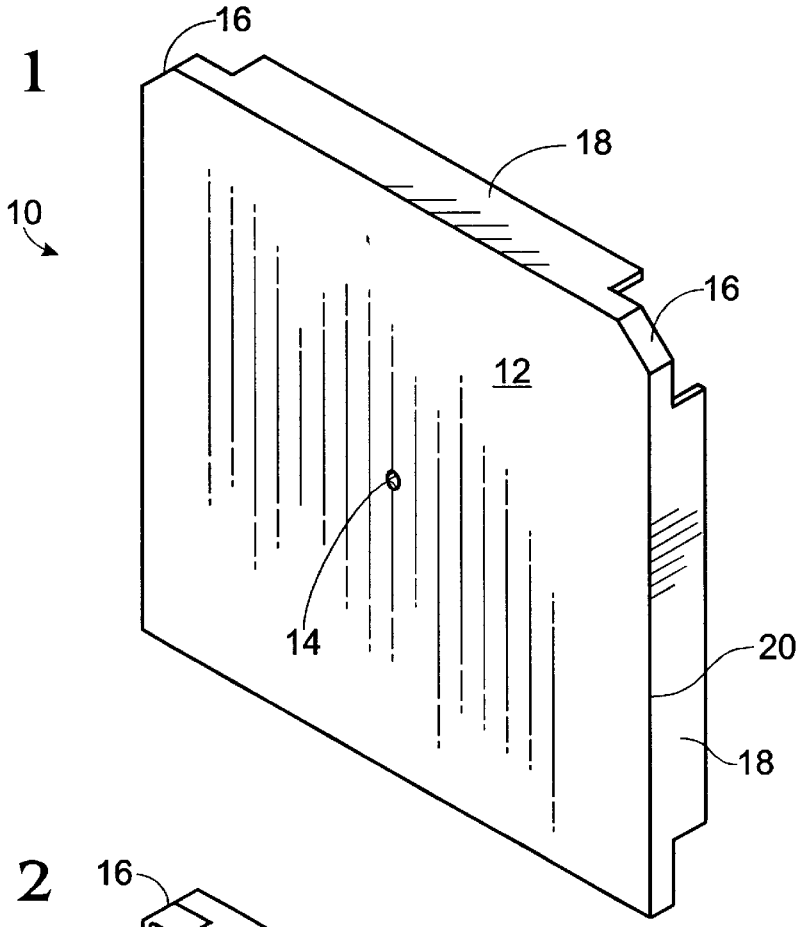
FIG. 1 is a front perspective view of the preferred embodiment of the crypt lock with the locking rods restrained and in the unlocked position.

Turning to the preferred embodiment, FIG. 1 shows a front view of a crypt lock in the unlocked position. The lock comprises a rigid plate 10 having a front face 12 and a centrally located hole 14 through the plate that is sized to receive a small screw. The plate 10 is sized to completely cover over the open end of a crypt, and is shown here as substantially square with two beveled corners 16, which is typical of most crypt openings, but may be any shape. The plate 10 is preferably made of non-corrosive steel, but can also be made of any suitably strong and rigid metal. For added security, integral side flanges 18 project rearwardly from the outer edges 20 of the front face 12 toward the crypt so that when the lock is positioned in the crypt, the flanges 18 fit inside and flush with the walls of the crypt. The flanges 18 are continuous with the outer edges 20 except at each corner to allow for the movement of four radially sliding locking rods 22 (see FIG. 2).

Figure 2:
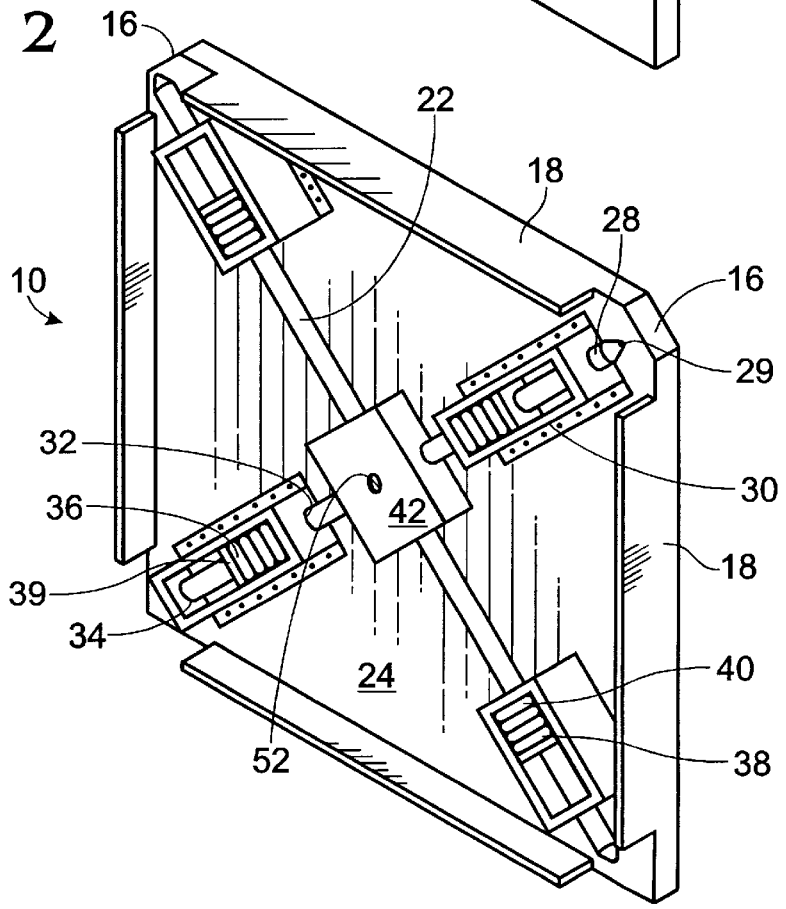
FIG. 2 is a rear perspective view of the crypt lock in FIG. 1 with the locking rods restrained and in the unlocked position.
Figure 4:
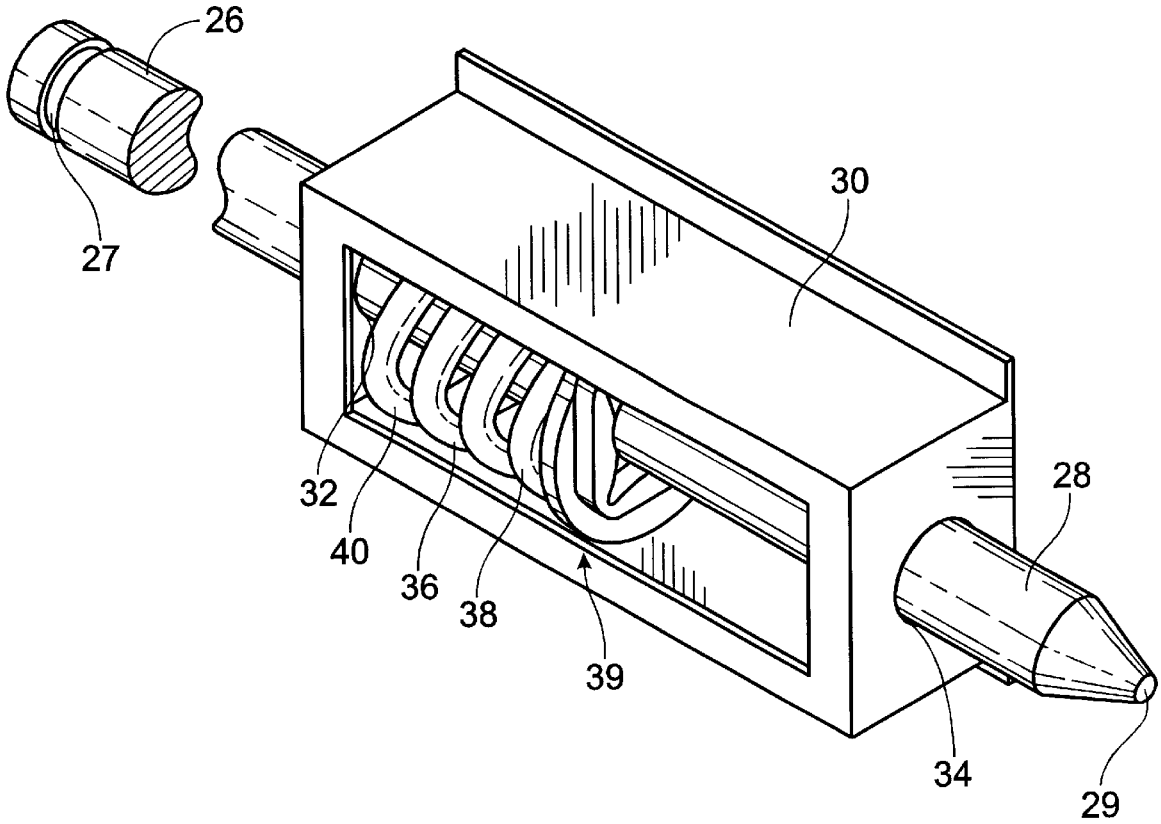
FIG. 4 is an enlarged perspective view showing the interconnection of the rod, housing, spring, and clip/washer of FIG. 2.
Figure 5:
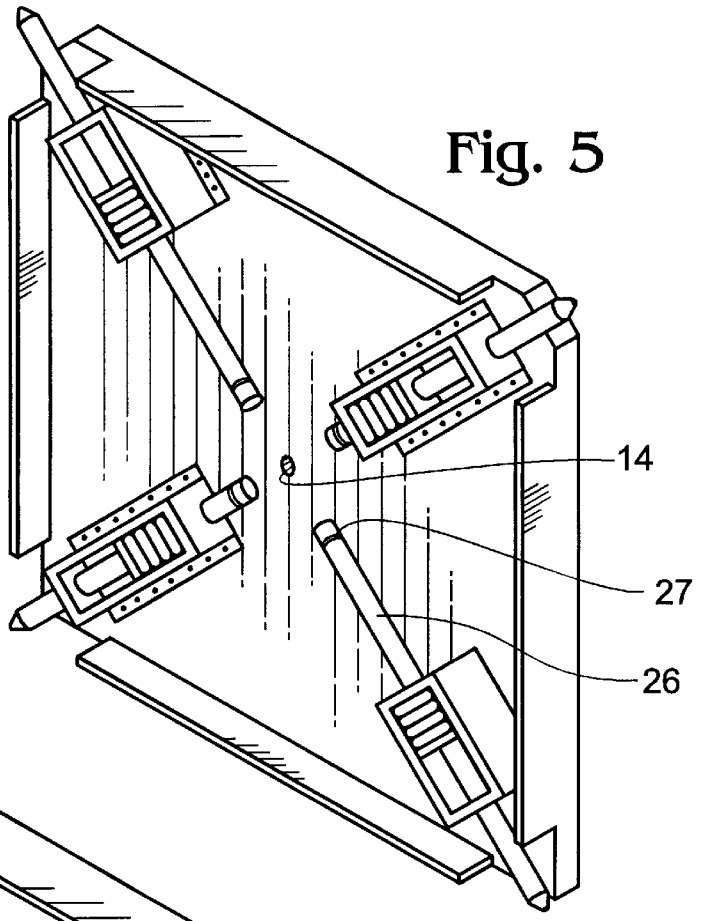
FIG. 5 is a rear perspective view of the crypt lock shown in FIGS. 1 and 2 with the locking rods in the locked position with the rod restraining clip removed.
Figure 6:
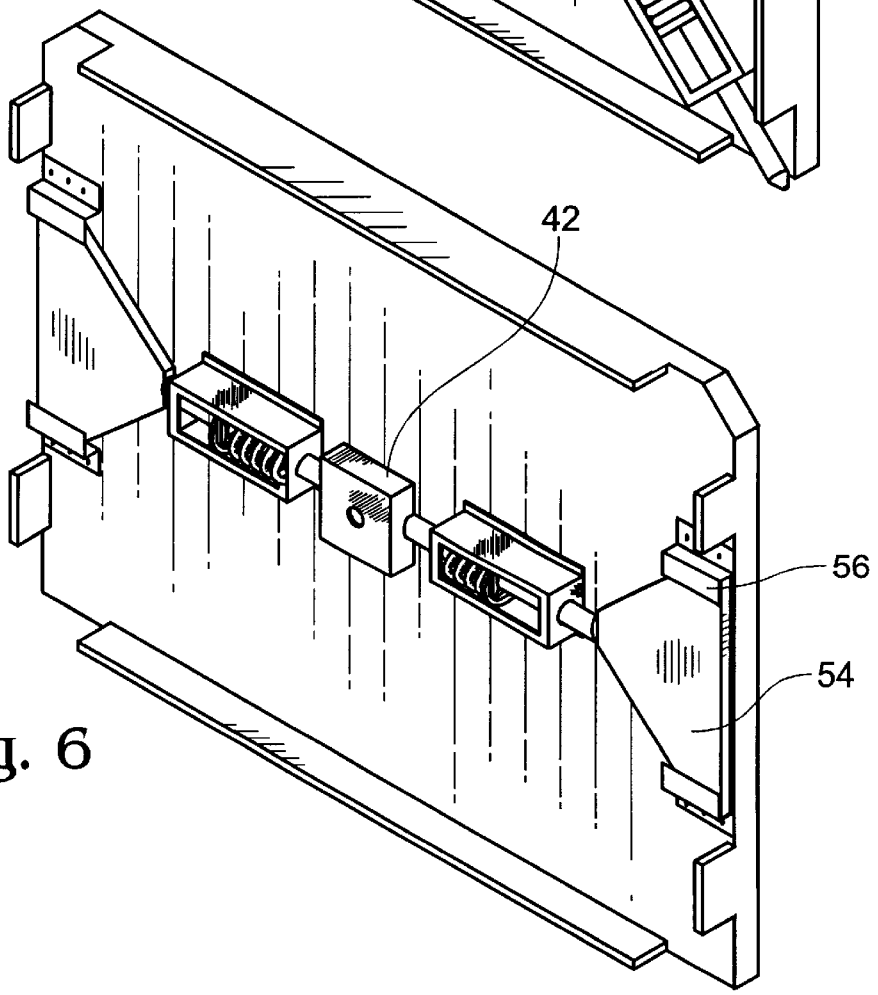
FIG. 6 is perspective view of another embodiment of the crypt lock designed to operate with custom mausoleum crypts.

FIGS. 2 & 5 illustrate a rear view of the crypt lock of FIG. 1. FIG. 2 shows the rods 22 in the unlocked restrained position, and FIG. 5 shows the rods 22 in the locked unrestrained position. The plate 10 further comprises a rear face 24. The four radially sliding locking rods 22 are positioned on the rear face 24. While four rods are shown, any number will suffice, but at least a plurality are necessary spaced equally apart from each other. The rods are preferably formed of hardened steel, but other sufficiently strong metals will suffice. Each rod 22 has an inner end 26 with a circumferential groove 27 (See FIG. 5), and an outer end 28 with a pointed tip 29. The inner end 26 of each rod is positioned adjacent the hole 14, and the outer end 28 of each rod is positioned adjacent the outer edges 20 where there are no flanges 18. As shown here the outer ends 28 of the rods 22 are positioned at each corner of the plate 10. Each rod 22 is guided and supported off the rear face 24 of the plate 10 by a housing 30 which is axially aligned with each rod 22. Each housing 30 is positioned over and adjacent the outer end 28 of each rod 22 so that each outer end 28 of each rod 22 passes through an inner end opening 32 and an outer end opening 34 of each housing 30. Preferably each housing 30 is made of rigid metal and is attached to the rear face 24 such as by spot welding. A spring 36 encircles each rod within each housing 30. A first end 38 of each spring 36 is attached to its respective rod 22 such as by a clip and washer combination 39 (and as shown in FIG. 4), and a second end 40 of each spring 36 is attached its respective housing 30 adjacent its respective inner end opening 32 of the housing 30. A rod restraining clip 42 is removably positioned over grooves 27 (see FIG. 4) in the inner ends 26 of the rods 22 and the central hole 14 so that the rods are kept in position until the lock is ready to be installed.

Figure 3:
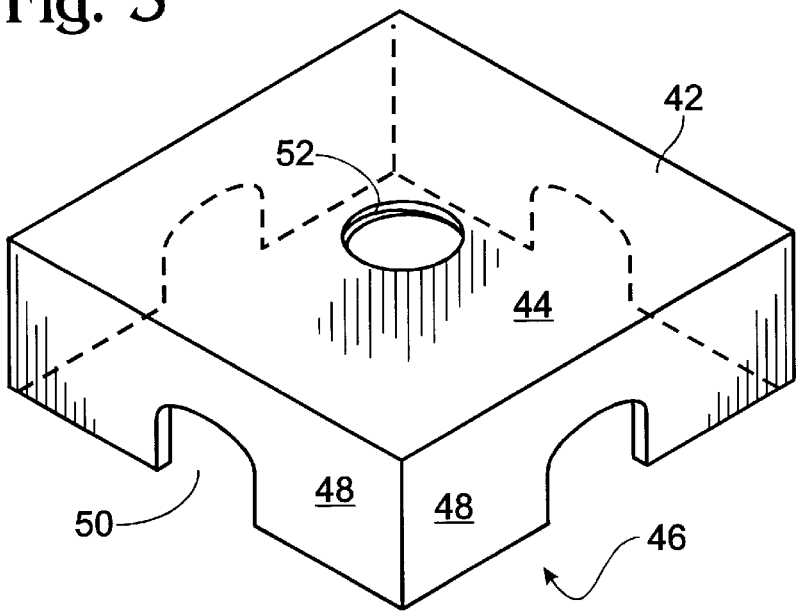
FIG. 3 is an enlarged perspective view of the rod restraining clip shown in FIGS. 1–2.

FIG. 3 is an enlarged perspective view of the preferred embodiment of the rod retaining clip 42. The clip 42 comprises a top section 44, an open bottom 46, and integral continuous side walls 48 extending downward from the top section 44. The side walls 48 have cut outs 50 shaped to fit snugly into the grooves 27 in the inner ends 26 of the rods 22 so that the clip 42 restrains the rods in the unlocked position until the lock is ready to be used. The top section 44 of the clip 42 has a centrally located threaded hole 52 sized to receive a small screw. When the clip is positioned, the hole 52 in the clip 42 is axially aligned with the hole 14 in the plate 10 so that a screw or other fastening device can be inserted through the hole 14 in the plate 10 and into the hole 52 in the clip 42 to provide safety i.e. the clip 42 will remain securely positioned until the lock is ready for use.

FIG. 4 is an enlarged perspective view showing the interconnection of the rod 22, housing 30, spring 36, and spring retaining clip and washer 39.

FIG. 5 is a rear perspective view of the rear face 24 of the crypt lock with the restraining clip 42 removed and the rods 22 in the extended and locked position. The pointed tips 29 and outer ends 28 would extend into a drilled hole in the frame of a mausoleum crypt (not shown).

FIG. 6 is a rear perspective view showing another embodiment of the crypt lock. Here, rather than pointed tips 29, the outer ends 28 of the rods 22 are shaped in a substantially flat wide blade 54. The blades 54 are supported by guides 56 attached such as by spot welding to the rear face 24 of the plate 10. The blades 54 are intended to fit snugly into slots built into the concrete frame of specially manufactured mausoleum crypts (not shown).

To cover and lock the crypt contents, the plate 10 is positioned into an open end of a crypt or compartment. The plate 10 is positioned to line up with receiving holes pre-drilled for the pointed ends 29 and rods 22, or with slots pre-shaped for the blades 54 in the crypt or compartment frame. Alternatively, if there are no receiving holes present, the plate 10 is positioned in the opening, and the frame is marked for drilling. Marks are made on the crypt or compartment frame to correspond to where the locking rods 22 will extend into the frame. Holes are then drilled into the frame for the locking rod outer ends 28. Once the plate 10 is in position and properly lined up, the safety screw is removed if necessary, a pin or other tool is put through the hole 14 and the restraining clip 42 is pushed off of the rods 22 with the pin. The rods 22 move into position due to the action of the springs 36 on the rods 22 such that the rods 22 when released extend in an outwardly direction from the center of the plate 10 and into the openings in the frame.

As can be seen, once the plate 10 is in position and locked, the retraction of the locking rods 22 is impossible due to the removal of the restraining clip 42 from the locking rods 22. Additionally, a potential vandal is not induced to attempt the unlocking of the cover because there is nothing external to tamper with. All that is visible is the front face 12 of the plate 10 and the hole 14. If the potential vandal puts a tool into the hole 14, there will be nothing but empty space available as the restraining clip 42 will have fallen to the floor of the crypt. The lock is also simple to install as it requires just placement, possibly some drilling, and the removal of the clip 42. The person installing the lock is left with no guesswork as far as the disablement of the actuating means, that is the clip 42, and no cement or sealant are required. Finally, due to the simplicity of design and few parts necessary, the lock is cost effective.

The description above should not be construed as limiting the scope of the invention but as merely providing illustrations of some of the presently preferred embodiments of this invention. For example, the retaining clip can have other shapes, such as a circular, triangular, or rectangular top section; the housing can be attached to the rear face of the plate in a variety of ways; and while the number of rods is required to be at least two, one of the rods can be a fixed rod, while the other is radially sliding. Therefore, the spirit and scope of the appended claims should not be limited to the description of the preferred versions contained herein.

What is claimed is:

1. A mausoleum crypt lock comprising a rigid plate, the plate having a centrally located hole sized to receive a small screw;

a plurality of radially sliding locking rods, each rod spaced equally apart from the other on the rear face of the plate, and an inner end of each rod positioned adjacent the center hole, each inner end having a circumferential groove and an outer end of each rod positioned adjacent the outer edges of the plate;

a housing for supporting and guiding each rod such that each rod is able to radially move outward, each housing having an inner end and an outer end, and each housing attached to the rear face of the plate adjacent the outer edges;

a spring for each rod, each spring encircling its respective rod within the housing, one end of each spring attached to the rod, and the other end of each spring attached adjacent the inner end of the housing; and a rod restraining clip, the clip non-rotatably and removably positioned centrally over the hole in the plate and in engagement with the over circumferential grooves thereby retaining the rods in a retracted position so that in use a pin inserted into the hole from the front side of the plate pushes the clip off of the rods, whereby the rods, no longer being restrained, are moved into position by the springs.

2. A crypt lock as in claim 1 further comprising rearwardly facing integral side flanges continuous with the outer edges of the plate except where the plurality of radially sliding rods move outward away from the plate for locking.

3. A crypt lock as in claim 1 wherein said outer ends of the rods are pointed tips.

4. A crypt lock as in claim 1 wherein said outer ends of the rods are flat blades.

5. A crypt lock as in claim 1 wherein said rod retaining clip comprises a flat top section with a centrally located threaded hole for receiving a screw, an open bottom, and integral side walls extending downward from the top section, the walls having cut outs corresponding to the circumferential grooves in the inner ends of the rods such that the clip when positioned has a snug fit over the rods.

6. A crypt lock as in claim 1 wherein said plate and said rods are non-corrosive steel.

7. A crypt lock as in claim 1 wherein the plurality of rods equals four and each rod is positioned to slide out toward the comers of the plate.

* * * * *